US005669095A

United States Patent [19]

Dausch et al.

[11] Patent Number: 5,669,095

[45] Date of Patent: Sep. 23, 1997

[54] ADAPTIVE WATER LEVEL CONTROLLER FOR WASHING MACHINE

[75] Inventors: Mark Edward Dausch, Latham; Vivek Venugopal Badami, Niskayuna; Walter Whipple, III, Amsterdam, all of N.Y.; Cynthia Fanning Forester, Louisville, Ky.

[73] Assignee: General Electric Company, Schenectady, N.Y.

[21] Appl. No.: 717,592

[22] Filed: Sep. 23, 1996

Related U.S. Application Data

[63] Continuation of Ser. No. 496,114, Jun. 28, 1995, abandoned.

[51] Int. Cl.[6] ..... D06F 33/02; D06F 39/08

[52] U.S. Cl. ..... 8/158; 8/159; 68/12.02; 68/12.04; 68/12.05; 68/207

[58] Field of Search ..... 8/158, 159; 68/12.02, 68/12.04, 12.05, 12.19, 12.21, 23.5, 207

[56] References Cited

U.S. PATENT DOCUMENTS

| | | | |
|---|---|---|---|
| 4,303,406 | 12/1981 | Ross | 8/158 |
| 4,480,449 | 11/1984 | Getz et al. | 68/12 R |
| 4,481,786 | 11/1984 | Bashark . | |
| 4,607,408 | 8/1986 | Didier et al. | 8/159 |
| 4,754,622 | 7/1988 | Fanson | 68/207 |
| 4,862,710 | 9/1989 | Torita et al. . | |
| 5,031,426 | 7/1991 | Wilson | 68/207 |
| 5,042,276 | 8/1991 | Kamano et al. | 68/12.04 |
| 5,130,624 | 7/1992 | Bashark . | |
| 5,144,819 | 9/1992 | Hiyama et al. | 68/12.04 |
| 5,161,393 | 11/1992 | Payne et al. | 68/12.04 |
| 5,208,931 | 5/1993 | Williams et al. . | |
| 5,230,228 | 7/1993 | Nakano et al. . | |
| 5,233,847 | 8/1993 | Tanaka | 68/121.04 |
| 5,237,256 | 8/1993 | Bashark . | |
| 5,241,845 | 9/1993 | Ishibashi et al. | 68/12.02 |
| 5,275,025 | 1/1994 | Nakamura et al. | 68/12.04 |
| 5,291,626 | 3/1994 | Molnar et al. | 8/158 |
| 5,293,760 | 3/1994 | Tani et al. | 68/12.02 |
| 5,313,964 | 5/1994 | Dausch et al. | 134/57 D |
| 5,330,580 | 7/1994 | Whipple, III et al. | 134/18 |
| 5,408,716 | 4/1995 | Dausch et al. | 8/158 |

FOREIGN PATENT DOCUMENTS

| | | |
|---|---|---|
| 415743A1 | 3/1991 | European Pat. Off. . |
| 62-66895 | 3/1987 | Japan . |

*Primary Examiner*—Philip R. Coe

*Attorney, Agent, or Firm*—Donald S. Ingraham

[57] ABSTRACT

An energy efficient washing machine includes a control system that provides a cleansing fluid level that is optimized for effective cleaning of the soiled articles and includes a closed loop adaptive water level controller that controls the addition of water into the machine. The adaptive water level controller includes an agitator load signature monitor and an agitator work-determining processor, the processor being coupled to the agitator load signature monitor and a cleansing fluid supply system and adapted to generate a fluid supply control signal in correspondence with an agitator work signal, which signal is generated by the processor in correspondence with iterative respective agitator load signature values corresponding to strokes of the agitator. A method of determining the optimal fill level for the cleansing fluid in a washing machine includes the steps of operating an agitator disposed in the washer basket to displace articles to be cleansed; determining a plurality of respective agitator load signature values during the operation of the agitator; processing the respective agitator load signature values to determine an agitator minimal work point signal; and generating a cleansing fluid supply system control signal in correspondence with the agitator minimal work point signal to provide the optimal cleansing fluid fill level for the articles to be cleansed that are disposed in the washing machine.

31 Claims, 6 Drawing Sheets

ADAPTIVE WATER LEVEL CONTROLLER FOR WASHING MACHINE

This application is a Continuation of application Ser. No. 08/496,114 filed Jun. 28, 1995 now abandoned.

BACKGROUND OF THE INVENTION

This invention relates generally to energy efficient washing machines for cleansing clothes and similar articles and more particularly to washing machines having control of the amount of water added to cleanse the articles to be washed.

Optimizing energy usage of household appliances holds the potential for collectively providing significant energy savings. In washing machines, for example, effort has been expended on enhancing the clothing to water ratio (e.g., by reducing the unusable space between the basket and the tub in the washer) and controlling water temperature. Most conventional washing machines have manual load size selection, such as for "Small," "Medium," or "Large" loads; such manual control necessitates the machine operator to estimate clothes load and make the appropriate control selection. U.S. Department of Energy information on washer usage patterns indicates that nearly three-quarters of all loads are washed using the highest water level setting available, which often is in excess of that needed to provide effective cleaning of the articles to be washed.

It is thus desirable to provide an automated control system that can consistently provide an optimal water level in the washer for efficient cleansing.

SUMMARY OF THE INVENTION

In accordance with this invention, an energy efficient washing machine includes a control system that provides a cleansing fluid level that is optimized for effective cleaning of the soiled articles while also reducing water consumption of the machine compared with conventional manual fluid level control machines. An energy efficient washing machine includes a cleansing fluid supply system, a washer basket having an agitator device for displacing the articles to be cleansed within the basket, and a closed loop adaptive water level controller coupled to the cleansing fluid supply system and to the drive system for the agitator. The adaptive water level controller includes an agitator-load signature monitor and an agitator-work determining processor, the processor being coupled to the agitator-load signature monitor and the cleansing fluid supply system and adapted to generate a fluid supply control signal in correspondence with an agitator work signal, which signal is generated by the processor in correspondence with iterative respective agitator load values corresponding to strokes of the agitator. One example of an agitator-load signature monitor is a drive motor phase angle monitor that detects the phase angle of the motor driving the agitator device during respective strokes of an agitator cycle.

A method of determining the optimal fill level for the cleansing fluid in a washing machine in accordance with this invention includes the steps of operating an agitator device disposed in the washer basket to displace articles to be cleansed; determining a plurality of respective agitator work load values during the operation of the agitator; processing the respective agitator work load values to determine an agitator minimal work point signal; and generating a cleansing fluid supply system control signal in correspondence with the agitator minimal work point signal that is at or near the minimal work expended by the agitator so that the optimal cleansing fluid fill level is obtained for that particular load of articles to be cleansed.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

Figure 1:
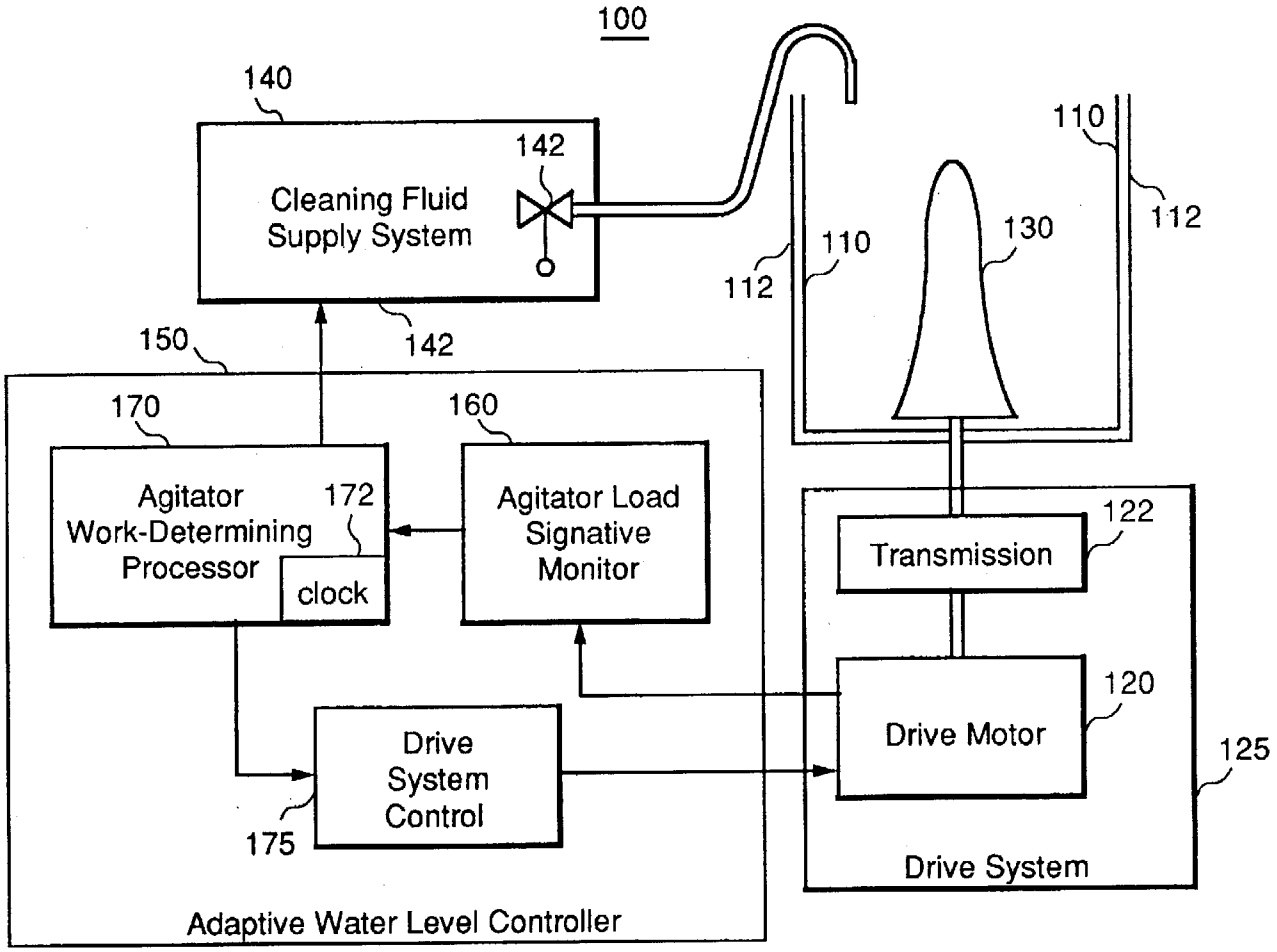
FIG. 1 is a block diagram of a washing machine in accordance with this invention.

A washing machine 100 comprises a washer basket 110 that is movably disposed within a washer tub 112; washer basket 110 is further coupled to a drive system 125 so as to allow rotation of basket 110 within tub 112. Drive system 125 comprises, for example, a drive motor 120 and a transmission 122 that may further include drive belts, gearing, and the like that translate the rotational motion of the drive motor shaft into the desired motion of components within washing machine 100; alternatively, in some arrangements motor 120 can be coupled to directly drive components of machine 100 without a transmission. An agitator device 130 is further disposed within basket 110 and is coupled to drive system 125 such that it can be rotated or displaced within basket 110. As used herein, "agitator device" or "agitator" refers to an apparatus that imparts oscillatory motion to the articles and water within basket 110; for example, agitators commonly have vanes and the like mounted on a columnar structure, but alternatively may comprise pulsator or impeller devices that induce desired motion in the articles and water within basket 110. A cleansing fluid supply system 140 is disposed so as to provide a cleansing fluid to fill tub 112 and basket 110 (basket 110 typically is perforated, which allows fluid communication between tub 112 and the interior of basket 110). In accordance with this invention, an adaptive water level controller 150 is coupled to cleansing fluid supply system 140 and to drive system 125 and is adapted to generate a control signal for fluid supply system 140 to provide an optimal fill level for the cleansing fluid in basket 110 during wash cycles of machine 100.

A wash cycle of machine 100 typically includes a wash operation and a rinse operation; commonly machine 100 further has a spin operation. The wash operation comprises adding the cleansing fluid (which most commonly comprises water) to the basket (containing the articles to be cleansed and detergent) to the optimal fill level, agitating for a specified period, and then draining cleansing fluid; agitation refers to oscillatory motion of agitator 130 to move the water and articles to be washed within basket 110 to provide the mechanical action to assist in the cleaning of the articles. In the rinse operation, the basket is again filled to a desired level, the rinse water and clothes are agitated for a specified period, and the water is then drained. In machines having the capability, basket 110 is spun at a high speed to assist in the removal of water from the articles that have been washed. In most washing machines, the wash cycle comprises one wash cycle and one rinse cycle, alternatively, multiple wash, spin, and rinse cycles may be optional as necessary for specific clothes loads.

As illustrated in FIG. 1, washing machine 100 comprises a vertical axis washer, that is, the rotation of basket 110 and agitator 130 is about a vertical axis. Effective cleansing of the articles in the washing machine requires an adequate amount of water (although other cleansing fluids can be used, water is the most common and is used herein by way of example and not limitation), which is typically referred to as the "fill level," that is, the level in the basket 110 to which the water is filled. Examples of measures of washing machine performance include the turnover adequacy of the machine, a soil removal index, the mechanical action performance (with respect to the articles agitated in the basket), a tangling index, and measurements such as no excessive splashing of water in the basket. Effective cleansing of the articles, as indicated by each of such measures, depends to a large extent on having an optimal level of water in the machine; if the water level is too low, the articles to be cleaned are subject to significant stress due to mechanical displacement by the agitator; the addition of too much water may cause some articles to float and thus have decreased interfacial wash action, with the consequence that water is wasted (along with the energy to heat, pump, and agitate the water) and the articles do not receive the desired motion within the basket for optimal cleaning or rinsing. Further, optimal water level should provide an adequate detergent dilution ratio to ensure that in the articles to be cleansed are adequately rinsed.

In accordance with this invention, adaptive water level controller 150 provides an optimal fill level for each wash cycle that the machine is used. The optimal fill level provides: adequate turnover (typically the standard is that identified items in a wash are circulated top to bottom and back (or vice versa) within each wash operation) (one example of such a test protocol is the Consumer's Union turnover test); adequate cleanliness of the articles washed (e.g., as measured by the soil removal index based on change in reflectivity of soiled articles before and after washing); washing action that does not damage the clothing articles (e.g., at an appropriate index, such as one determined by the Danish Mechanical Action Test); an acceptable tangling index (e.g., as measured by the intertwining of multiple long-sleeved shirts after washing); and, no splashing of water out of the machine during agitation.

Drive system 125 is adapted to drive agitator 130 in an oscillatory motion. For example, an oscillatory agitation cycle typically involves a forward stroke followed by a reverse stroke, with the agitator arc and velocity during each stroke being determined by drive system 125 (for example, set in the fabrication process by reason of the selection of gearing in transmission 122 and the operating characteristics of drive motor 120). The articles disposed in basket 110, together with the water in the basket that is displaced by the agitator as it oscillates, create a reactive torque on agitator 130 which provides an agitator load signature that is reflective of the work being expended to displace the agitator, articles to be cleansed, and water in the basket. Such an agitator load signature is further evidenced in a corresponding reactive torque on drive system 125. Further, this reactive torque on drive system 125 varies such that the amount of reactive torque on drive motor is least near the optimal water level, that is, a water level that is sufficient to provide effective cleansing of the articles in basket 110. At less than the optimal water level, the reactive torque on agitator 130 (and hence drive system 125) is greater than that seen at the optimal water level due to the work required of the agitator to mechanically displace the clothing (without the "lubrication" of sufficient water to facilitate movement of the articles); agitation at less than the optimal water additionally has deleterious effects on the articles themselves. At higher than the optimal water level, the reactive torque on agitator 130 (and drive motor 120) is also greater than the level of reactive torque experienced at the optimal water level due to the displacement of the extra mass of water beyond that required for adequate turnover.

The reactive torque on agitator 130 during agitation cycles provides a load signature that corresponds to the fill level of water in machine 100; that is, as noted above, the reactive torque typically has a minimum value at the optimal fill level such that the optimal fill level can be deduced from analysis of the load signature of agitator 130 (which load signature corresponds to the work necessary to displace the agitator during agitation cycles). Direct or indirect indications of agitator load can be used to generate the load signature from agitation cycles. When the value of such load measurements is at or near zero (given the accuracy of measurement devices), the optimal fill level has been reached; one method of determining "near zero" is set forth below and includes monitoring the derivative value of the load signature. For example, direct measurement of torque, such as through a torque sensor (e.g., a strain gage) coupled to the drive shaft of agitator 130 can be used; alternatively, indirect measurements, such as electrical parameters of drive system 125, can be used. Examples of indirect measurements include the phase angle of an AC induction drive motor 120, or measurement parameters (e.g., current or voltage measurements) of torque-command motors (also referred to generically as controlled speed motors) such as electronically commutated motors (ECM), switched reluctance motors (SRM), universal motors, or the like. For each type of electrical motor noted, the load on the motor can be determined by measurement of selected electrical parameters of the motor, and those parameter measurements can thus be used to generate the agitator load signature. AC induction motors are commonly used in mass-manufactured household appliances as such motors are comparatively simple, reliable, robust, and effectively provide the motive power for the various functions of machine 100.

Figure 2:
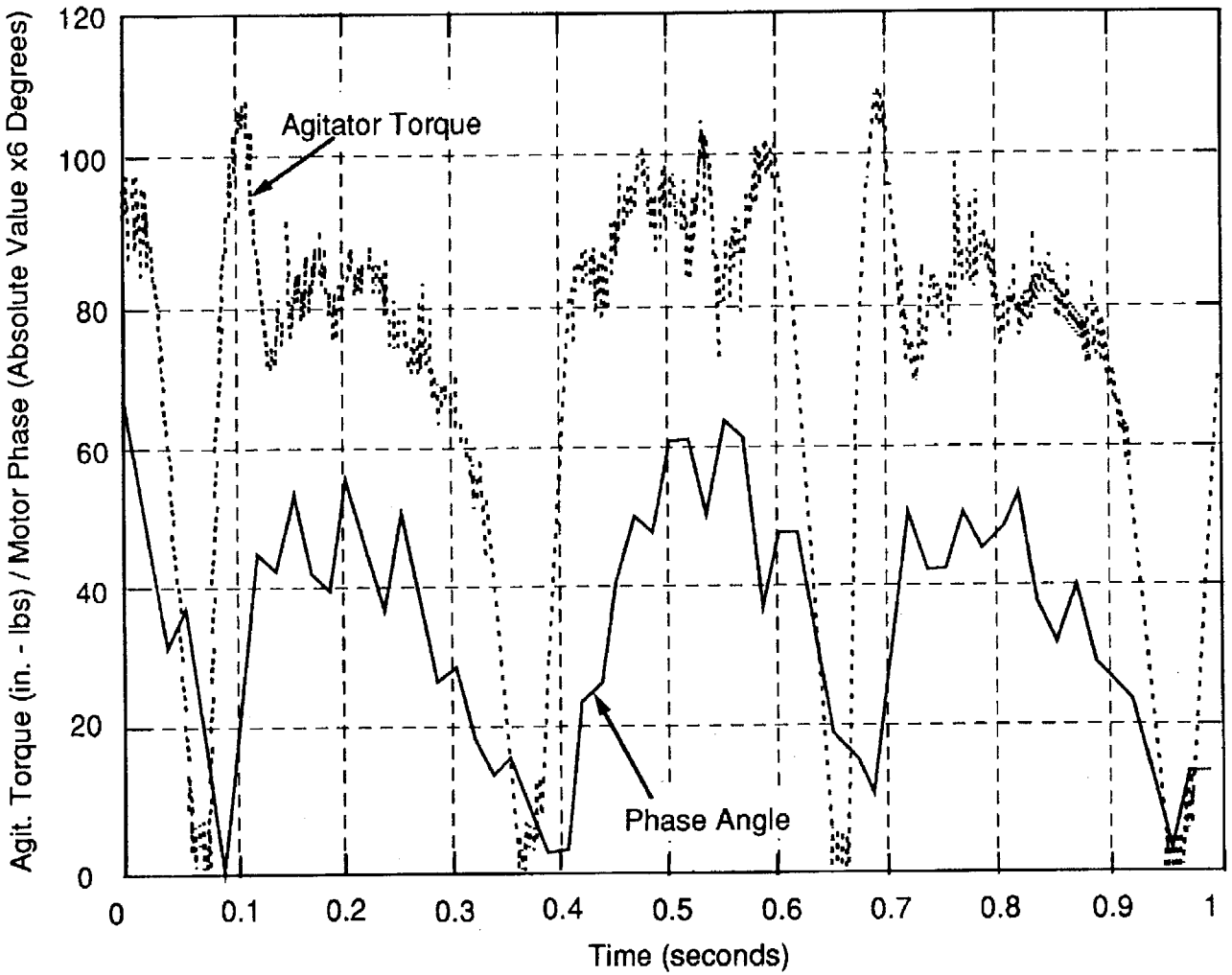
FIG. 2 is a graphic representation of drive motor phase angle values plotted with temporally corresponding agitator torque values.

Drive motor 120 is thus typically an AC induction motor, and the amount of reactive torque (or load) on the motor is evidenced by the phase angle of the motor. Phase angle typically refers to the number of electrical degrees (for a sinusoidal oscillation) of the phase difference between the current and the voltage in the stator windings of the motor (in the AC induction motor, current lags voltage so that, as load increases, the phase angle decreases, and as load decreases, the phase angle increases (towards 90°)). As used herein, "motor phase angle information" or the like refers to any expression of the motor phase angle, such as actual measurements or related values derived from the actual measurements such as the inverse, e.g., [90°—motor phase angle], or peak to peak values of respective minimum and maximum phase angles in the electrical cycles (as described more fully below). As will be evident to one skilled in the art, a variety of expressions of phase angle are available, each of which communicates load signature data for agitator 130. In FIG. 2 measurements from a strain gage attached to an agitator in a machine are plotted along with temporally coincident phase angle information from the drive motor driving the agitator in the agitation cycles; as is apparent from the graph, motor phase angle provides a corresponding signature to the directly-measured torque on the agitator.

In accordance with this invention, adaptive water level controller 150 comprises a closed feedback control system in which the agitator load signature is provided by measurement of motor load through motor phase angle information. Agitator load signature (e.g., drive motor 120 phase angle information) is used for determining the optimal water level for a particular load of articles to be cleansed. Controller 150 comprises an agitator load signature monitor 160 and an agitator work-determining processor 170 that are coupled together; monitor 160 is further coupled to drive system 125 so as to sense information from which agitator load signature information is generated for processing by work-determining processor 170. Work-determining processor 170 is coupled to fluid supply system 140 so as to provide a signal to control cleansing fluid level in basket 110; for example, the control signal generated by processor 170 typically is used to actuate a supply valve 142 (or alternatively, multiple supply valves (not shown), such as separate hot and cold water valves) that controls fluid flow into tub 112 and basket 110. Processor 170 is further typically coupled to a drive system control circuit 175 so as to generate control signals to drive motor 120 to control agitation cycles of agitator 130 in conformance with the method set out below.

In accordance with one embodiment of the present invention, agitator load signature monitor 160 comprises a phase angle monitor such as a device for monitoring phase (typically measured between zero current and zero voltage points in an AC waveform, alternatively, other corresponding points in the waveform can be used by the monitor) as is disclosed in U.S. Pat. No. 5,313,904 or similar devices. Agitator work-determining processor 170 comprises a microprocessor, microcontroller, application specific integrated circuit (ASIC), digital signal processor (DSP), or the like. In accordance with this invention, processor 170 typically is an 8-bit processor or similarly robust and readily manufactured device that is easily manufactured and uniformly programmed in large quantities. Commonly, processor 170 comprises a clock circuit 172 that provides timing information for sequencing processing and generation of control signals to implement the optimal fill method of the present invention.

Examples of motor phase angle information data processed in accordance with this invention for the portion of the wash cycle following an initial fill is illustrated graphically in FIGS. 3(A)–3(D), and are used by way of example and not limitation to illustrate the operation of controller 150 (other measures of agitator load can be used to provide a corresponding signature reflecting reactive torque on the agitator during agitation cycles as the washer is filled). In the normal wash cycle for operations in which water is added (e.g., wash and rinse operations), an initial fill level of water is typically established in basket 110 prior to the commencement of the agitation cycles described below. The level of initial fill may be some standard level (for each wash cycle), an operated selected set point, or determined in some other manner, such as by an inertial load sensing method as described in copending application Ser. No. 08/406,424, filed 20 Mar., 1995, assigned to the assignee herein, and incorporated by reference. Providing an initial fill of water before commencing agitation minimizes damage to the articles to be washed from mechanical action of agitator 130 without water present and prevents excessive load on the drive system. Additionally, continued fill beyond the initial fill level provides the reactive torque profile (and corresponding drive motor work profile) of decreasing reactive torque as fill level approaches the optimal fill level and increased torque for addition of water beyond the optimal fill level.

Figure 3A:
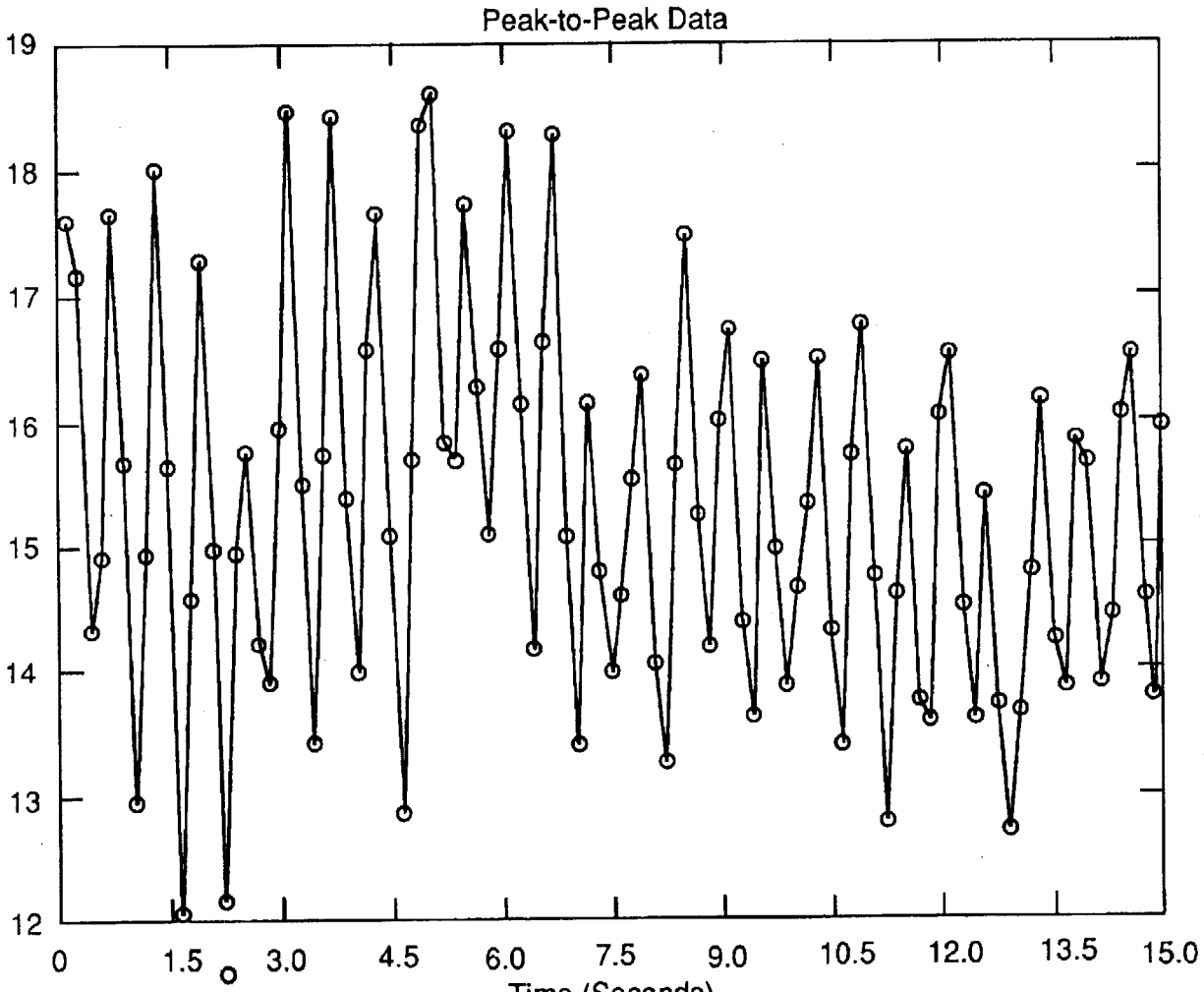
FIGS. 3(A)–3(D) are graphic representations of data derived in steps of processing of drive motor phase angle values processed in accordance with this invention.

In FIG. 3(A) representative peak to peak motor phase angle information is illustrated for a plurality of agitation cycles in washing machine 100. By way of example and not limitation, the phase angle information represented in FIG. 3(A)–3(D) is presented as the inverse of actual phase angle information, that is: {90°—phase angle}; this presentation of phase angle information is selected for convenience as the values of phase angle information plotted decrease as agitator load decreases, and increase as agitator load increases.

Each agitation cycle of agitator 130 includes a forward stroke in which agitator 130 is rotated in a first direction of rotation (for example, in a machine having transmission 122 in drive system 125, the arc of rotation is typically in the range of about 110° to 115°) followed by a reverse stroke (rotation of agitator 130 through and equivalent arc of rotation but in the opposite direction as the forward stroke). Typically adaptive water level controller 150 is designed to sample the load signature indications at a rate of about at least 10X the frequency of the signal of interest; by way of example and not limitation, in one embodiment of the present invention the frequency of agitator 130 strokes is about 1.6 Hz, and thus processor 170 is collecting data from agitator load signature monitor 160 at a time interval in the range of 0.0167 sec/data point. Other sampling rates can be used that are tied to the AC line frequency (e.g., 50 Hz or 60 Hz, so that one might sample at one or two times the line frequency), or alternatively, if sufficient computing power is available in processor 170, fewer points can be sampled while still being able to determine with accuracy the respective waveforms of the current and voltage so that phase angle information can be determined.

From the phase angle information (e.g., values expressed as {90°—sensed phase angle} for the Figures and examples used herein), the minimum phase angle value, the following maximum phase angle value, and the next following minimum phase angle value are used to determine respective peak to peak phase angle values seen at motor 120; as illustrated in FIG. 3(A), the peak to peak phase data for this representative example varies between about 12° and 19°.

Figure 3B:
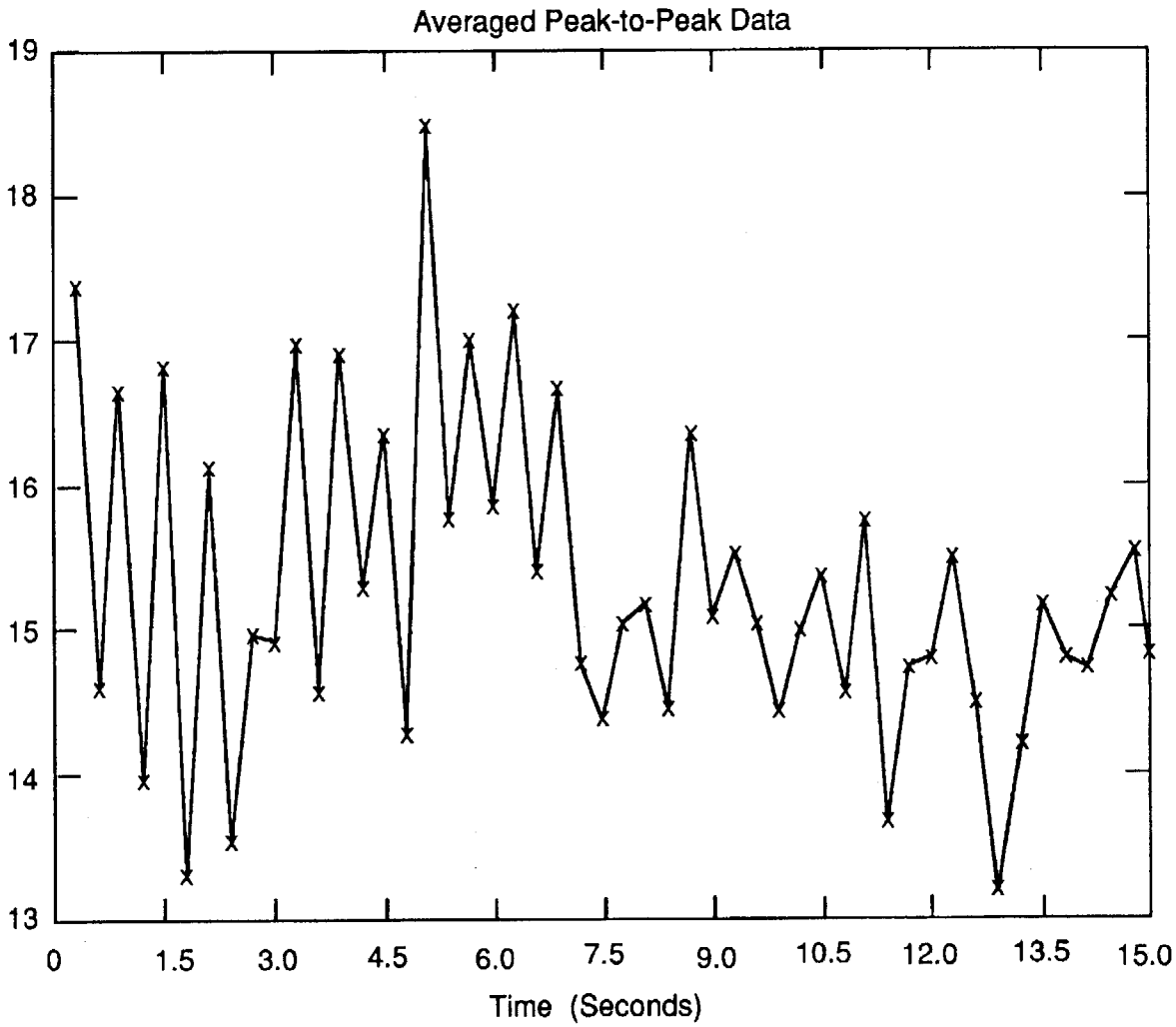

Next, processor 170 determines an average peak to peak value for each stroke of agitator 130. This average peak to peak value for each stroke is illustrated in FIG. 3(B) and is determined from respective sequential peak to peak phase data values, that is, for each stroke "i":

$$\Phi_{pi}=((\Phi_{max\ i}-\Phi_{min\ i-1})+(\Phi_{max\ i}-\Phi_{min\ i+1}))/2$$

Next, processor 170 determines the total phase change for each agitation cycle, that is, the phase change over both the forward and the reverse stroke of agitator 130. Determining the total phase change for each agitation cycle is accomplished by adding the average peak to peak values for each respective cycle, that is, a pair of sequential forward and reverse stroke (e.g., $\Phi_{tot\ pi}=\Phi_{pi\ fwd\ stroke}+\Phi_{pi\ rev\ stroke}$). This sum provides agitation cycle-specific phase angle information and corresponds to the total reactive torque encountered by the agitator as it moved in both directions (both strokes), encountering different articles in each direction; this total phase angle information further is representative of the work expended by the drive motor in displacing the agitator through the forward and the reverse stroke of the agitator.

Processor 170 next determines a block average of respective total phase change values for a selected number of agitation cycles. Typically eight agitation cycles are used in determining respective block averages. As processor 170 commonly comprises an eight-bit processor, it is desirable in such an arrangement that the number of agitation cycles be divisible by two. This block average of total phase change values for several agitation cycles tends to smooth the phase change data as illustrated in FIG. 3(C), which is helpful for further processing as disclosed below.

Figure 3C:
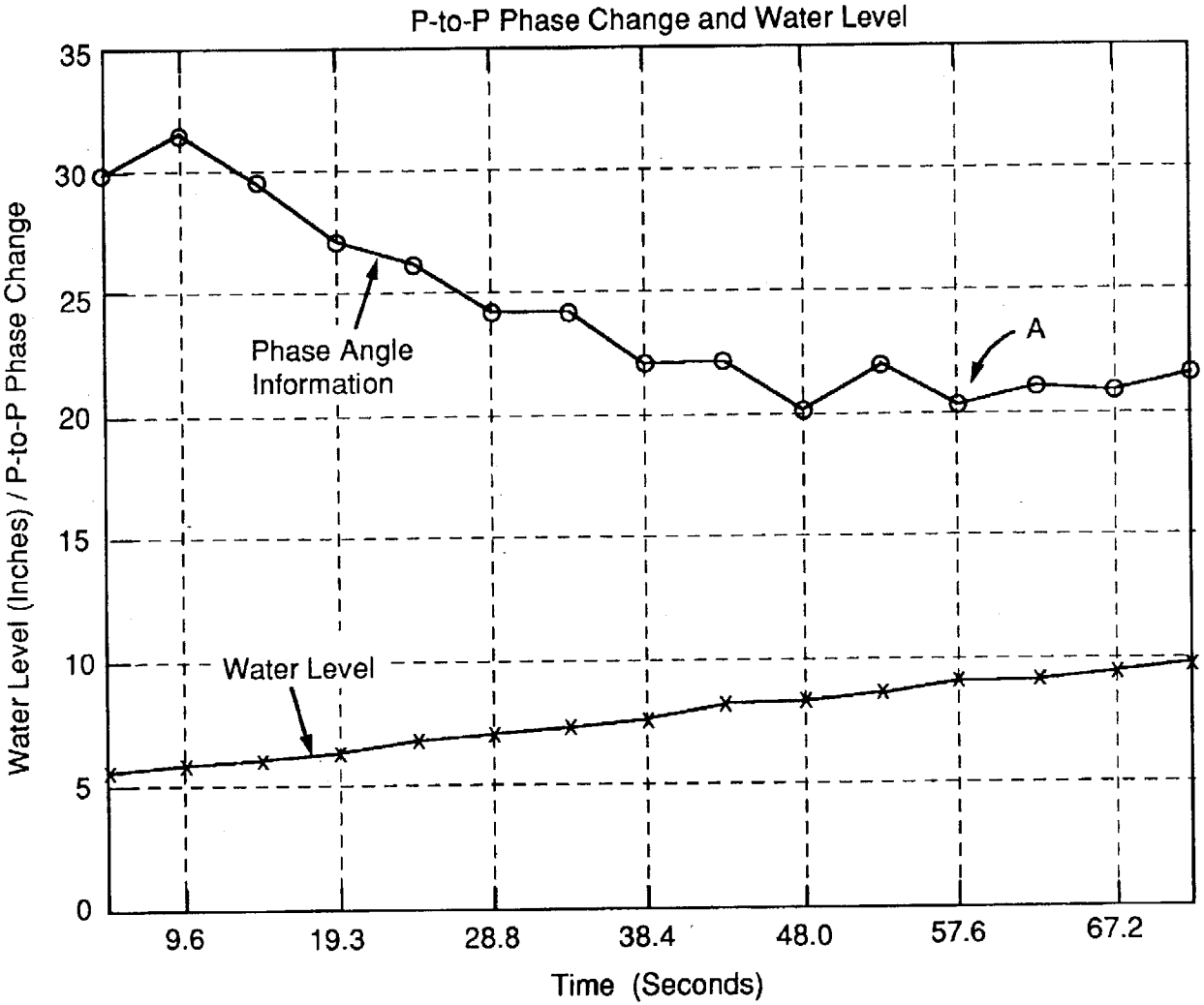
Figure 3D:
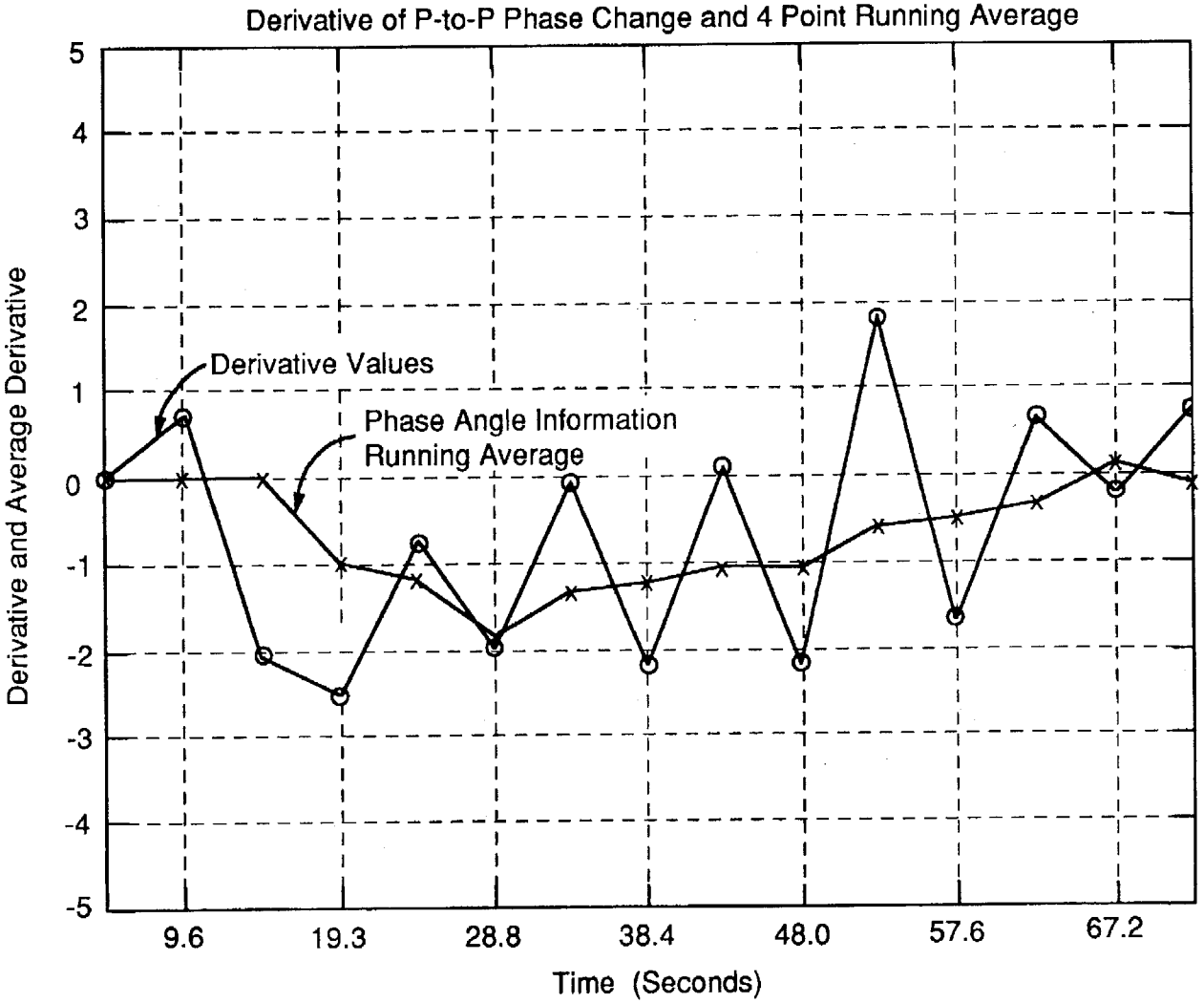

FIG. 3(C) further graphically presents water level data that temporally corresponds to the respective eight point averages of the phase change information; as is evident from the Figure, the block average of respective total phase change values for agitation cycles declines as water is added to a point, after which the block average of respective total phase change values begins to increase. The declining phase change values are indicative of corresponding decreasing reactive torque on agitator 130 as water is added, with the point of least reactive torque corresponding to the level of water providing desired turnover of the articles in basket 110. This optimal water level corresponds to the agitator minimal work point, which is identified in the Figure with an arrow at point "A"; the minimal phase angle change value corresponds to the point at which drive motor 120 is expending the least work in displacing agitator 130 within basket 110 to move the articles and water in the basket. As water is added beyond the optimal fill level, the reactive torque increases as the amount of water beyond that necessary for adequate turnover of the articles to be washed is added; this increased reactive torque is further manifested as additional work expended by motor 120 to displace agitator 130 within basket 110.

In accordance with this invention, processor 170 next determines the derivative (that is, the slope of the curve) of the block averages of the agitator load signature values; in the example described herein, that signature is illustrated by the total phase angle change information. The derivative information is an expression of whether the agitator load for respective agitation cycles (as presented in the block averages) is declining, constant, or increasing. For the phase angle information used in this example (e.g., the "inverse" of direct phase angle measurements), the values are seen to decrease as motor load decreases and increase as motor load increases. In the illustration of FIG. 3, the declining agitator load is shown as a decrease in the phase angle information values (thus resulting in a derivative for this part of the curve that is negative); when the agitator load is steady, the value the derivative of the sequential block values of the phase angle information is zero; when agitator load is increasing the value of the derivative of the sequential block values of phase angle information is positive. As noted above, the point of minimum work (or reactive torque on the agitator) corresponds with (that is, is closely related to) the optimal fill level for water in the washing machine basket. Thus, as the value of the derivative approaches zero, the washing machine has been filled nearly to the optimal fill level; continued filling beyond that point results in additional work expended by motor 120 to displace agitator 130 and hence the derivative of the block average of the total phase change information turns positive and remains so as water addition continues after reaching the optimal fill level for the particular load of articles to be cleansed.

Typically processor 170 further processes the derivative information determined from the block averages of phase angle information by determining a running average of the derivative values determined. The running average provides a smoother data curve for use in generating a cleansing fluid supply system control signal to cease the addition of water as the derivative value approaches zero. One example of a running average is illustrated in FIG. 3(C); by way of example and not limitation, the running average illustrated is a four-point running average, and is plotted for comparison purposes along with raw values of derivatives.

In accordance with this invention, processor 170 next generates the cleansing fluid supply system control signal when the running average of derivative values approaches zero. As used herein, a "near zero" derivative value or a value that "approaches zero" refers to a derivative value that is less than 10% of a predetermined typical maximum change in phase angle during the fill process to the optimal level; which can be expressed mathematically as:

$$\frac{\partial\,\Delta\text{ phase angle}}{\Delta t} < (0.1)\,(\Delta\text{ phase angle}_{max})$$

The predetermined typically maximum change in phase angle ($\Delta$ phase angle $_{max}$) for a fill evolution is empirically determined, and typically is a function of starting water levels, load size, water temperature, and the like. As noted above, the fill level at which the derivative values of the agitator load (such as drive motor phase angle information) begin to approach zero represents the optimal fill level and the level at which the work expended by drive system 125 to displace agitator 130 and the articles and water in basket 130 reaches its minimum.

Typically processor 170 further comprises a counting circuit that counts the number of near zero derivative values so as to minimize the chance of an anomalous measurement resulting in premature cessation of filling of the washing machine. After a predetermined number of near zero values have been counted (e.g., 3 values that are near zero (even if non-consecutive)), processor 170 generates the control signal to cleansing fluid supply system 140. The cleansing fluid supply control signal is typically an electrical signal to cause supply valve 142 (or alternatively multiple supply valves) to close.

Thus, adaptive water controller 150 provides the optimal fill level for a particular load of articles to be cleansed by monitoring the load signature of agitator 130 that is periodically operated in agitation cycles to displace the articles to be washed and the water added thus far in the fill process. At the point where the work expended by the drive motor to displace the agitator approaches its minimum (the near zero derivative value), the processor generates a signal to control the water supply system to stop filling the tub and basket of the washing machine. The fill level is optimized both for the size of the load (e.g., the mass of the clothes) and also for the type of fabrics involved; certain types of fabrics, such as synthetics, absorb less water than cottons, for example, and thus more water is needed to wash cotton fabrics. The adaptive water level controller in accordance with this invention thus provides the optimal fill level that is adapted both for the size of the load of articles and for the type of fabric of the articles to be cleansed. By consistently controlling the filling of the washing machine with cleansing fluid to an optimal level that is appropriate for each respective load, the adaptive water level controller in accordance with this invention reduces energy use and water use by the washing machine, and further provides improved washing action for the articles to be cleansed (e.g., by avoiding underfilling, which results in poor soil removal and damage to clothes from mechanical action of the agitator, and from overfilling, which reduces washing action because of decreased interfacial cleaning of the clothes.

In operation, the user of washing machine 100 adds the articles to be cleansed (and detergent) to basket 110 and initiates the wash cycle. After an initial fill of water, adaptive water controller 150 generates signals to drive motor 120 to operate agitator 130 in one or more agitation cycles. Agitator load signature information (such as drive motor phase angle information) from drive system 125 during these agitation cycles is processed in agitator work-determining processor 170 to generate a fluid supply system control signal to stop the addition of water when the machine has been filled to the optimal level for that load of articles to be washed. In the example described above, processor 170 accomplishes this task by generating average phase angle information relating to respective agitation cycles and generating the derivative of the sequential average phase angle information. After filling, the wash operation is completed (e.g., with further agitation to provide cleansing of the articles and draining) and rinse and spin operations are undertaken. Optimal fill level for rinse operations can be generated in the same fashion; alternatively, the rinse level can be the same as the fill level in the wash operation or some predetermined portion of the wash operation fill level.

It will be apparent to those skilled in the art that, while the invention has been illustrated and described herein in accordance with the patent statutes, modifications and changes may be made in the disclosed embodiments without departing from the true spirit and scope of the invention. It is, therefore, to be understood that the appended claims are intended to cover all such modifications and changes as fall within the true spirit of the invention.

What is claimed is:

1. A washing machine for cleansing articles with a cleansing fluid, the washing machine comprising:

a cleansing fluid supply system;

a washer basket disposed in said washing machine and adapted to receive articles to be cleansed, said washer basket being disposed to receive cleansing fluid from said cleansing fluid supply system, said basket further having an agitator device disposed therein and that is coupled to a drive system, said agitator being disposed in said basket so as to displace cleansing fluid and articles to be cleansed in response to motion of said agitator; and a closed loop adaptive water level controller coupled to said cleansing fluid supply system and to said drive system, said adaptive water level controller further comprising an agitator load signature monitor and an agitator work-determining processor, said processor being coupled to said agitator load signature monitor and said cleansing fluid supply system and adapted to generate a fluid supply control signal in correspondence with an agitator work signal, said agitator work signal being generated by said work-determining processor in response to signals from said agitator load signature monitor.

2. The device of claim 1 wherein said drive system comprises a drive motor and said adaptive water level controller further comprises a drive motor control circuit to generate respective signals to operate said drive motor to provide strokes of said agitator.

3. The device of claim 2 wherein said agitator load signature monitor is selected from the group consisting of a direct load measurement device and an indirect load measurement device.

4. The device of claim 3 wherein said indirect load measurement device is selected from the group consisting of a motor phase angle detection device and a load-determining monitor for a torque-command electric motor.

5. The device of claim 4 wherein said adaptive water controller further comprises a clocking device coupled thereto.

6. The device of claim 5 wherein said clocking device is adapted to provide agitator load signature sampling intervals in the range ten times the frequency of the signal measured by said agitator load signature monitor.

7. The device of claim 4 wherein said agitation work-determining processor comprises means for determining a derivative value of a plurality of agitator load signature signals.

8. The device of claim 7 wherein said controller is further adapted to generate said fluid supply control signal to cease the addition of cleansing fluid in correspondence with a selected value of said agitator load signature derivative.

9. The device of claim 8 wherein said selected value of said agitator load signature value derivative is within 10% of a predetermined maximum phase angle difference for a fill operation.

10. The device of claim 4 wherein said drive motor comprises an AC induction motor.

11. The device of claim 10 wherein said water level controller is adapted to generate a plurality of iterative averaged motor phase angle values from which said agitator load signature derivative is determined.

12. The device of claim 2 wherein said cleansing fluid supply system comprises at least one water supply valve responsive to control signals generated by said adaptive water controller.

13. The device of claim 1 wherein said agitator work-determining processor comprises a component selected from the group consisting of microprocessors, microcontrollers, application specific integrated circuits, and digital signal processors.

14. A method of determining with an adaptive water level controller an optimal fill level for cleansing fluid in a washing machine, the washing machine having a washer basket for receiving articles to be cleansed, comprising the steps of:

operating an agitator disposed in said washer basket, said agitator being coupled to a drive system to operate said agitator in agitation cycles, determining a plurality of respective agitator load signature values representing operation of said agitator in said agitation cycles;

processing said plurality of respective agitator load signature values to determine an agitator minimal work point signal; and generating a cleansing fluid supply system control signal to in correspondence with said agitator minimal work point signal to provide said cleansing fluid optimal fill level in said washing machine.

15. The method of claim 14 wherein said agitator load signature value comprises a signal selected from the group consisting of agitator torque values, agitator drive system load values, phase angle values for a drive motor in said drive system, and control parameters of a torque-command motor.

16. The method of claim 15 in which the step of determining a plurality of respective agitator load signature values comprises the step of determining a plurality of respective block averages of agitator load values corresponding to respective cycles of said agitator.

17. The method of claim 16 wherein the step of processing said plurality of respective block averages of said agitator load signature values comprises iteratively computing an agitator load signature derivative of iterative respective block averages.

18. The method of claim 17 wherein the step of determining said agitator minimal work point signal comprises generating said minimal work point signal in correspondence with the occurrence of said agitator load signature derivative approaches zero.

19. The method of claim 18 wherein said agitator load signature derivative approaches zero at values less than 10% of a predetermined maximum load signature variation for a washing machine filling operation.

20. The method of claim 17 in which the step of determining said respective block averages comprises determining a respective drive motor total phase angle change for each agitation cycle.

21. The method of claim 20 wherein the step of determining a respective drive motor total phase angle change for each agitation cycle comprises summing respective average peak to peak phase angle change values for a forward stroke and a reverse stroke for each respective one of said agitation cycles.

22. The method of claim 21 further comprising the step of sampling drive motor phase angle values at a sample interval at the rate of at least 10 times the frequency of the agitation cycle.

23. The method of claim 20 wherein the step of processing said plurality of respective block averages of said drive motor phase angle values comprises iteratively computing a drive motor phase angle derivative of iterative respective block averages.

24. The method of claim 23 wherein the step of processing said plurality of respective block averages further comprises determining a running average of said iterative drive motor phase angle derivatives.

25. The method of claim 24 wherein said running average of said iterative drive motor phase angle derivatives in a four-point running average.

26. The method of claim 23 wherein the step of determining said agitator minimal work point signal comprises generating said minimal work point signal in correspondence with the occurrence of a drive motor phase angle derivative value approaching zero.

27. The method of claim 26 wherein said drive motor phase angle derivative value approaches zero at values less than 10% of a predetermined maximum phase angle variation for a washing machine filling operation.

28. The method of claim 26 wherein the step of generating said cleansing fluid supply system control signal is substantially temporally coincident with the generation of said agitator minimal work point signal.

29. The method of claim 28 wherein said cleansing fluid supply system control signal comprises a fill valve closure signal.

30. The method of claim 16 wherein the step of determining said agitator load signature values comprises determining phase angle information at said drive motor during said agitation cycles.

31. The method of claim 16 wherein the step of determining said respective block averages of phase angle values comprises the step of averaging said total drive motor phase angle change for eight sequential agitation cycles.

* * * * *